United States Patent [19]

Kircher

[11] 4,028,210

[45] June 7, 1977

[54] CONNECTION MEANS FOR ANODE POSTS IN ELECTROLYTIC DIAPHRAGM CELLS

[75] Inventor: Morton S. Kircher, Clearwater, Fla.

[73] Assignee: Olin Corporation, New Haven, Conn.

[22] Filed: Nov. 28, 1975

[21] Appl. No.: 636,242

[52] U.S. Cl. ..... 204/266; 204/288

[51] Int. Cl.[2] ..... C25B 9/00

[58] Field of Search ..... 204/266, 286, 288

[56] References Cited

UNITED STATES PATENTS

| | | | |
|---|---|---|---|
| 2,987,463 | 6/1961 | Baker et al. | 204/266 |
| 3,437,579 | 4/1969 | Smith | 204/286 X |
| 3,752,756 | 8/1973 | Armstrong et al. | 204/266 X |
| 3,857,775 | 12/1974 | Custer et al. | 204/266 X |
| 3,891,531 | 6/1975 | Bouy et al. | 204/266 X |
| 3,954,593 | 5/1976 | Schmidt | 204/266 X |

*Primary Examiner*—C. F. Lefevour

*Attorney, Agent, or Firm*—Donald F. Clements; James B. Haglind; Thomas P. O'Day

[57] ABSTRACT

An improved means for connecting anode posts to diaphragm cell bases is described which utilizes an interior layer having a liquid-tight sealing means for each anode post. In addition, each anode post is secured to a separate opening in the cell base with solder to provide a good conductivity connection.

In a preferred embodiment of the sealing means a non-metallic tube is secured at its lower end to the interior layer and at its upper end to the anode post by an adjustable clamp to obtain a liquid-tight seal.

8 Claims, 3 Drawing Figures

CONNECTION MEANS FOR ANODE POSTS IN ELECTROLYTIC DIAPHRAGM CELLS

Figure 1:
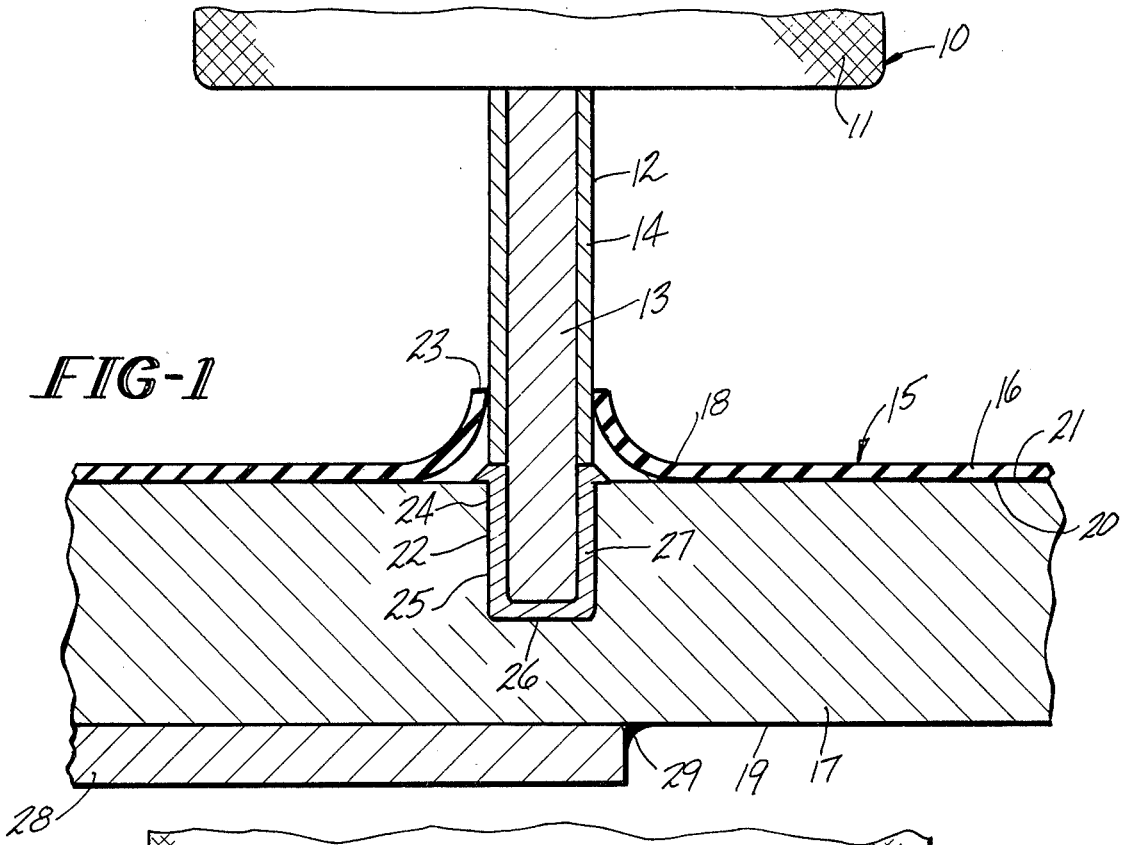

This invention relates to an electrolytic diaphragm cell having improved connection means for anode posts.

Electrolytic cells have been used extensively in the preparation of chlorine and caustic by the electrolysis of brine in a number of different cell designs. One of the problems in all of these designs is to provide a satisfactory means for conducting current from the ambient side or exterior surface of the electrolytic cell, through the cell base or wall to the anolyte container of the cell.

One type of cell design, the electrolytic diaphragm cell, is typically constructed of a steel cell can or body, a concrete top, and a concrete base. Graphite anodes were secured with lead and an asphaltic sealer in the cell base, and steel mesh cathodes coated with an asbestos diaphragm were suspended from the sides of the cell body. Recently the graphite anodes have been replaced by metallic electrodes having a suitable conducting coating on the outer surface of the anodes. It is preferable not to use lead to support these metallic anodes, which are sometimes referred to as "dimensionally stable anodes" because the conducting surface coating of the electrodes may become contaminated. As a result of this and the desire to improve electrical connections to these new metallic anodes, the structure of the conventional electrolytic diaphragm cell had to be modified in order to permit an improved installation of the dimensionally stable anodes.

U.S. Pat. No. 2,799,643, issued to C. W. Raetzsch on July 16, 1957, discloses a cell design for passing current to anodes secured to the sides of the cell container. This patent discloses cell bodies constructed of various non-conductive materials such as rubber covered steel.

U.S. Pat. No. 3,591,483, issued July 6, 1971, to Loftfield et al, describes a cell modification in which the cell base is a laminate of an electrically non-conductive sheet covering a metallic conducting and supporting cell base. Holes for receiving anode posts are formed in the non-conductive sheet and cell base and threaded anode posts are extended through the holes and secured to the cell base with threaded nuts and a suitable washer. The holes in the sheet are larger than the anode post.

Recently U.S. Pat. No. 3,891,531, issued on June 24, 1975, which describes a technique for securing anode posts to conductive cell bases employing either a flanged anode post with a threaded bottom which extends through the cell base, or an anode post having an outside diameter equal to or oarger than the diameter of the opening in the cell bottom at operating conditions, with internal channels in the lower portion of the anode post for conducting nitrogen gas for freezing the lower portion of the post to reduce its diameter prior to inserting it into the opening in the cell base. Subsequent expansion of the lower portion of the anode post provides a friction type liquid tight seal.

Although designs such as these may represent an improvement over conventional concrete diaphragm cells, one of the problems encountered in the use of the threaded anode post is the added expense of preparing threaded anode posts. Likewise, the utilization of anode posts having internal channels for liquid nitrogen is a relatively extensive and cumbersome means of obtaining a liquid tight seal in electrolytic diaphragm cells.

There is a need at the present time for an improved means for connecting anode posts to electrolytic diaphragm cells.

It is a primary object of this invention to provide an improved anode connection for electrolytic diaphragm cells.

Another object of the invention is to provide an improved electrolytic diaphragm cell in which anodes can be easily replaced or positioned within the cell.

Still another object of the invention is to provide a novel means for connecting anode posts in eletrolytic diaphragm cells.

These and other ofjects of the invention will be apparent from the following detailed description thereof.

It has now been discovered that the foregoing objects of the invention are accomplished in an electrolytic diaphragm cell comprised of a cell base having:

a. an interior layer which provides an interior surface,
b. a conducting layer which provides an exterior surface,
c. an interface between the bottom of said interior layer and the top of said conducting layer,
d. a cell body secured to said cell base,
   1. a plurality of diaphragm-coated cathodes secured to said cell body,
e. a plurality of anodes, each anode comprising,
   1. a metallic conductive surface secured to
   2. an anode post, said anode post secured to said cell base,
   3. each metallic conductive surface being positioned adjacent to and parallel to at least one of said cathodes,
f. and current conducting means secured to said exterior surface, characterized by the improvement which comprises in combination, g. soldered connections between each of said anode posts and said cell base, in a separate opening for each of said anode posts, and
h. liquid-tight sealing means between said interior layer and each of said anode posts.

FIG. 1 is a sectional elevation view of one embodiment of the invention in which the anode posts are secured by solder to the cell base in openings which extend partly through the lower layer of the cell base, and sealing means is provided by utilizing holes in the interior layer of smaller diameter than the diameter of the anode posts.

Figure 2:
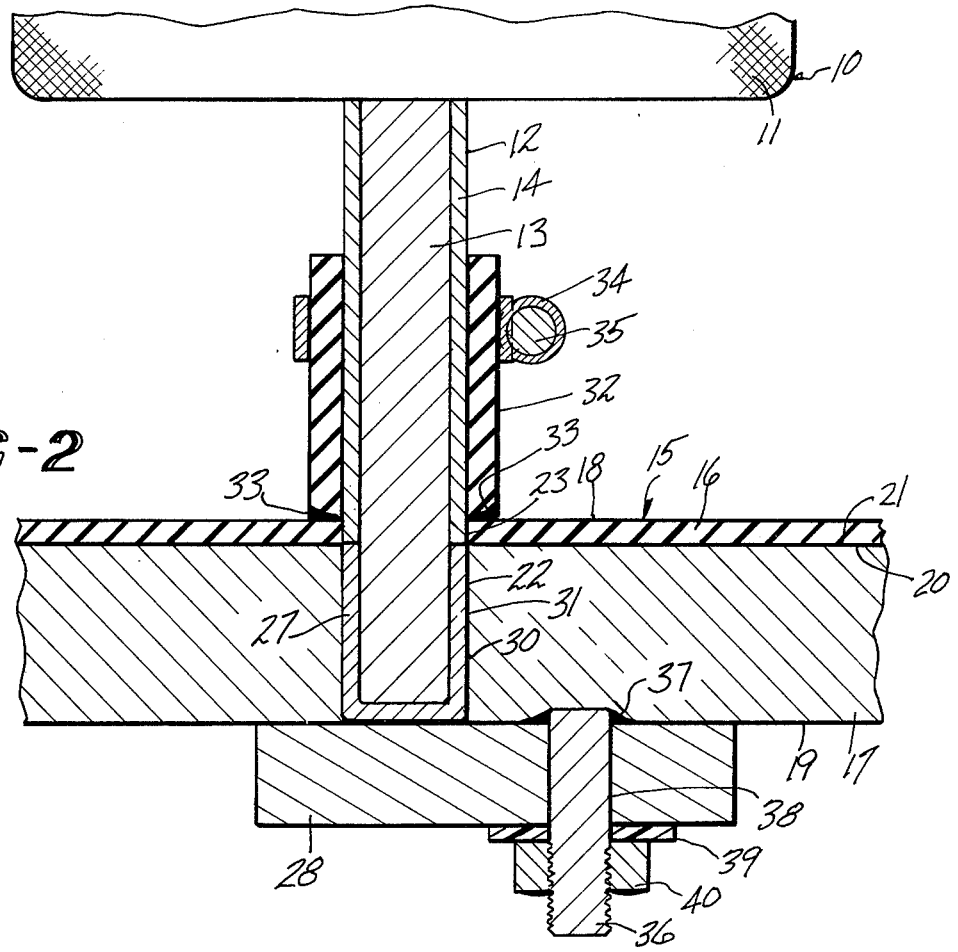

FIG. 2 is a sectional elevation view of another embodiment of the invention in which the anode posts are secured by solder to the cell base in openings which extend completely through the lower layer of the cell base, and sealing means in provided by utilizing sleeves positioned at one end around each opening in the interior layer and clamped at the other end to each anode post, the hole diameters in the interior layer corresponding to the diameter of the anode posts.

Figure 3:
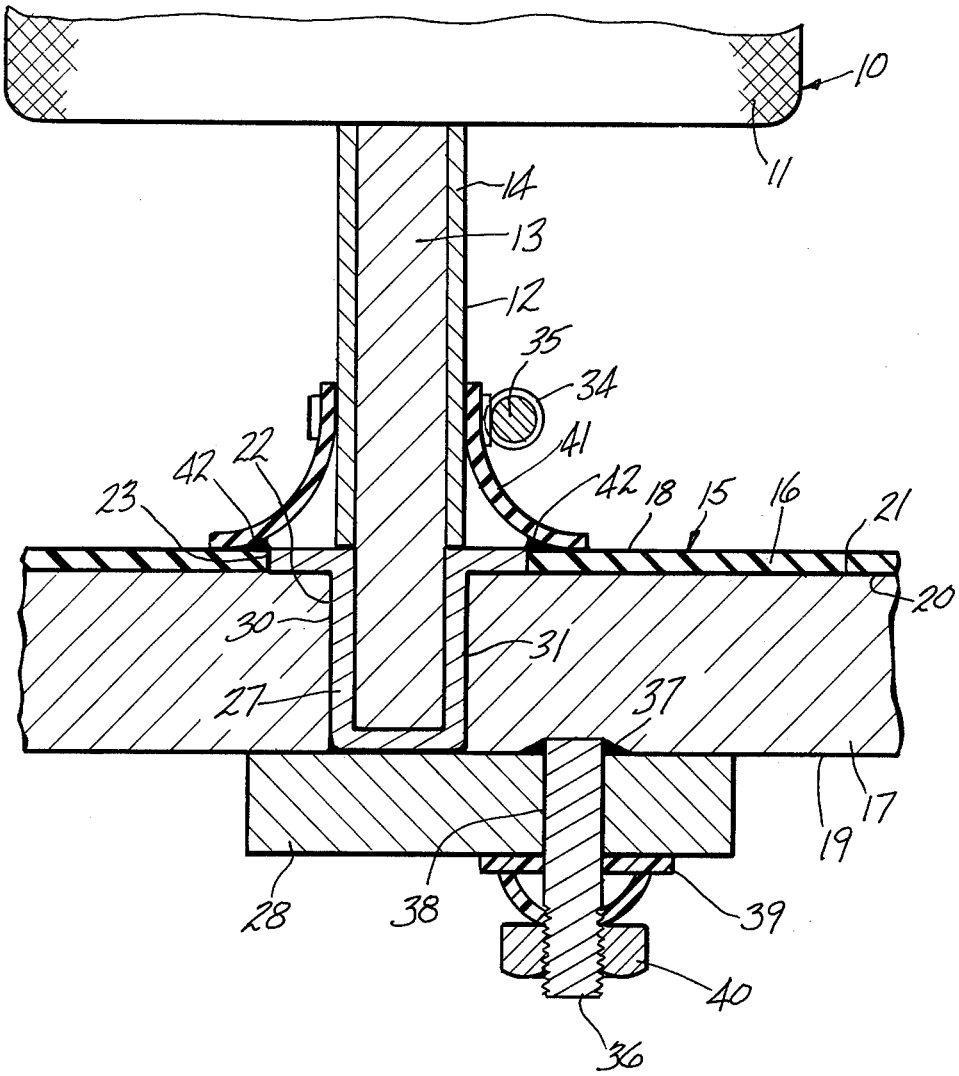

FIG. 3 is a sectional elevational view showing another type of sleeve sealing means wherein the hole diameters of the interior layer are larger than the diameters of the anode posts.

When the same component appears in more than one figure, the same number is used to identify this component in each figure.

More in detail, FIG. 1 shows anode 10 comprised of metal surface 11 and anode rod 12. Metal surface 11 may be a solid sheet, mesh or other suitable anode form comprised of a titanium base coated with at least one metal and/or metal oxide of a platinum group metal such as platinum or ruthenium oxide. However, other suitable metals, metal oxides, and mixtures thereof useful as these metal surfaces are well known in the art.

Anode rod 12 is comprised of core 13 clad with exterior sheet 14. Usually anode core 13 is constructed of aluminum, copper, iron, steel and the like and is clad with an exterior sheet 14 of corrosion resistant metal such a titanium. Although titanium is generally utilized for exterior cladding 14, other suitable metals of construction which resist corrosion by the electrolyte include tantalum, columbium and zirconium.

Cell base 15 is a laminated cell base comprised of an upper interior layer 16 secured to a lower conducting layer 17.

Interior layer 16 has an interior surface 18 which serves as the floor of the cell to contain the electrolyte. Interior layer 16 is generally a non-metallic corrosion resistant material such as rubber, polyethylene, chlorinated polyvinyl chloride, polypropylene, acrylonitrile-butadiene-styrene polymers (ABS), polytetrafluoroethylene (PTFE), polyvinylidene fluoride polyester (PVFP), fluorinated ethylene propylene (FEP), ethylene chlorotrifluoroethylene (E-CTFE), mixtures thereof and the like. The use of fiber reinforcement, such as fiber glass, in the material used to form interior layer 16 is preferred. A sheet of fluorinated ethylene propylene (FEP) sold commercially under the trademark "TELFON (FEP)" by the du Pont Company is preferably used as interior layer 16.

Lower conducting layer 17 has an exterior surface 19, and is constructed of aluminum, copper, iron, alloys of at least one of these metals, and the like. Steel is preferably used as conducting layer 17, which is joined at conducting layer top 20 with a suitable cement (not shown) to form interface 21 with interior layer 16 which provides a corrosion resistant bond over substantially the entire area of contact between interior layer 16 and conducting layer 17. Exterior surface 19 is generally exposed to the atmosphere.

A separate opening 22 is formed in cell base 15 for receiving each anode post 12. In the embodiment of FIG. 1, opening 22 is comprised of interior layer opening 23 in interior layer 16 and partial conductive layer opening 24 in conducting layer 17. Conducting layer opening 24 extends from conducting layer top 20 downwardly along walls 25 through a portion of conducting layer 17 to bottom 26. Generally the depth of partial conducting layer 24 ranges from about ½ to about ⅞ and preferably from about ¾ to about ⅞ of the thickness of conducting layer 17. Bottom 26 and walls 25 of partial opening 24 in conducting layer 17 provide adhering surfaces for solder 27 to secure anode post 12.

The portion of anode post 12 which extends into opening 22 has exterior sheet 14 removed, exposing core 13 to solder 27 for better adhesion of the solder. Generally, any soft solder is suitable for securing anode post 12 to conducting layer 17. A typical suitable solder is comprised of about 95 percent tin and about 5 percent silver. Other suitable solders contain from about 50 to about 60 percent tin and from about 40 to about 50 percent lead.

In the embodiment of FIG. 1 an electrolytic cell is shown having the liquid-tight sealing means of this invention which is comprised of an interior layer 16 having a. a plurality of openings 23 to receive anode posts 12,
   1. each opening 23 having a diameter smaller than the diameter of each anode post 12,
   2. the distance between the center of any two adjacent openings 23 in said interior layer 16 being greater than the distance between the centers of anode posts 12 positioned in adjacent openings 23,
   3. said openings 23 being raised from interface 21 between interior layer 16 and conducting layer 17, whereby a liquid-tight sealing means is formed between the wall of each of said openings 23 and the corresponding anode post 12. Even though the diameter of each opening 23 in the interior layer 16, in a relaxed condition, is smaller than the diameter of each of said anode posts 12, because of the flexible nature of the interior layer 16, holes 23 in the interior layer 16 are stretched to conform with the diameter of the anode posts 12, and to provide the liquid-tight sealing means by friction between the wall of each opening 23 and exterior sheet 14 of corresponding anode posts 12.

Conductor 28 is secured by welding 29, bolts (not shown) or otherwise in order to provide a strong electric contact with the bottom of conducting layer 17. Conductor 28 is preferably constructed of copper, but other materials such as aluminum may be used, if desired.

In the embodiment of FIG. 2, opening 22 is comprised of interior layer opening 23 and complete conducting layer opening 30 which extends completely through conducting layer 17.

Opening 30 is formed by walls 31 of opening 22 in FIG. 2 and extends from exterior surface 19 to interior surface 18.

In FIG. 2, sleeve 32 is positioned substantially perpendicular to interior surface 18 and welded thereto by means of plastic weld 33. Sleeve 32 is positioned concentric with opening 22 and preferably has an inside diameter corresponding to the diameter of wall 31. If desired, the internal diameter of sleeve 32, the diameter of interior layer opening 23 and the diameter of complete conducting layer opening 30 may each be different. It is preferred that the diameter of interior layer opening 23 is no larger than the diameter of anode post 12. Sleeve 32 is preferably constructed of the same material as interior layer 16, but may be constructed of any of the non-metallic substances referred to above for use in forming upper interior layer 16, provided a liquid-tight seal can be obtained with plastic weld 33 between the material used for interior layer 16 and the material used for sleeve 32.

In another embodiment of the invention sleeve 32 may be constructed of a suitable plastic material which is shrinkable when subjected to temperatures obtained during the soldering operation. For example, certain polyvinyl chlorides and polyethylene polymers as well as co-polymers of polyethylene with chlorotrifluoroethylene, may be used as sleeve 32. These shrinkable polymers, when heated to temperatures of above about 300° F. will shrink to form a liquid-tight seal between plastic sleeve 32 and anode post 12.

Anode post 12 is positioned in FIG. 2 within sleeve 32 and opening 22 and soldered, as in FIG. 1 in the area adjacent to wall 31 with solder 27. Solder 27 is not only capable of providing a liquid-tight seal to keep brine out of contact with corrodible metal components of the anode post 12 and conducting layer 17, but also provides electrical contact and support for anode post 12.

A suitable adjustable clamp 34 having screw head 35 is secured to the exterior of sleeve 32 in order to impart additional sealing means to inhibit contact of the electrolyte with corrodible metal components of anode post 12 and conducting layer 17.

The thickness of sleeve 32 depends on the size of the anode post 12 and opening 22. Generally, the thickness of sleeve 32 may range from about ⅛ inch to about ¼ inch. The height of the sleeve depends upon the height of the anode post 12 from interior surface 18 to the bottom of metal surface 11. Generally, the height of the sleeve ranges about ¼ to about ¾ of this distance. For example, when this distance is about 4 inches, the height of sleeve 32 ranges from about 1 to about 3 inches.

Conductor post 36 is secured to exterior surface 19 of conducting layer 17 by means of conductor post welding 37 or other suitable means. Conductor 28 having conductor opening 38 is placed in electrical contact with exterior surface 19 by passing conductor post 36 through conductor opening 38. A washer 39 and a nut 40 are then placed on the lower threaded portion of conductor post 36 and tightened against conductor 28 in order that the upper side of conductor 28 is in electric contact with exterior surface 19 of cell base 17.

FIG. 3 shows another embodiment of the invention in which a flexible sleeve with adjustable clamp type sealing means is employed wherein the hole diameter of interior layer 16 is larger than the diameter of anode post 12. In this embodiment, flexible sleeve 41 is secured by vulcanization or plastic weld 42 at its lower end to interior layer 16. The upper end of flexible sleeve 41 is secured by adjustable clamp 34 to anode post 12 in order to provide a liquid-tight seal around the anode post 12. Solder 27 fills the space in opening 22 of cell base 15, wherein opening 22 is comprised of interior layer opening 23 and complete conducting layer opening 30.

It will be recognized by those skilled in the art that the embodiments presented in the drawings can be modified wherein the opening in conducting layer 17 may extend completely through the cell base or may be a partial conducting opening layer, as desired.

If during the course of refurbishing the cell it is necessary to replace anode 10, solder 27 is melted, adjustable clamp 34, if present is removed, and anode 10 is withdrawn from the cell for renewal of metal surface 11. Another anode 10 is installed in place of the one removed.

The number of anodes 10 in the cell will usually correspond to the number of diaphragm-coated cathodes in the cell. The electrodes are positioned in the cell alternately, generally in a vertical position, with one anode being next to and spaced apart from a cathode. The cathodes are generally secured to the side of the cell and the anodes are positioned with anode posts 12 in at least one substantially straight row across the cell base 15. The number of anodes in each row and the number or rows of anodes, which corresponds to the number of conductors 28 in each cell, is not critical. Generally, the number of anodes in a row may range from about 2 to about 50 and preferably from about 10 to about 35 anodes per row. The number of rows of anodes (or conductors 28) may range from 1 to about 10 and preferably from about 1 to about 6 rows of anodes per cell. In a cell of this type, chlorine is produced at the anode, hydrogen is produced at the cathode, and each gas is collected separately.

Conductor 28 is generally a copper bar having a rectangular-shaped cross section, and attached at one end is a current source such as a bus bar. If desired, in order to provide a substantial uniform current distribution in anode posts 12 extending throughout each straight row or anode posts, a tapered conductor of decreasing thickness from the bus bar attachment to the opposite side of cell base 15 are employed in each row. As a result, when conductor 28 is secured to an operative bus bar (not shown) and current is fed to conducting means 28, a relatively uniform current distribution is achieved in anode posts 12 in each straight row across cell base 15.

The relative thickness of interior layer 16 and conducting layer 17 may also be varied with the size and shape of the electrolytic diaphragm cell. In a typical cell design, interior layer 16 is about ¼ inch thick and conducting layer 17 is about 1 inch thick. However, the thickness of interior layer 16 may range from about ⅛ inch to about 1 inch, and the thickness of conducting layer 17 may range about ½ inch to about 2 inches or more. Thicknesses which provide the desired degree of support without undue expense are usually employed.

Various modifications may be made in the invention without being outside the scope of the invention. For example, anode rods 12 have been illustrated and described as being cylindrical in cross sectional area, but rectangular, square or other forms of cross sectional area may be used instead of cylindrical rods.

The novel anode connection of this invention may also be used in other electrolytic cells, such as the chlorate type, where the diaphragm is omitted and the product is sodium chlorate, or in cells where the anode connections are through the side of the cell.

Advantages of using the novel conducting means and anode connection of this invention include the following:

1. The connection provides a short path for current from anode to conductive base; thus saving material and power.
2. The connection provides a highly conductive rigid structure, resistant to corrosion and readily engaged or disengaged by soldering.
3. The soldering type connection makes possible fastening of anodes from one side of the anode plate only. Fastening by other means would be difficult or impossible.
4. No tightening device is necessary for making the electrical connection. Nuts, washers, threads, etc. are eliminated. The electrolyte seal is independent of the electrical seal.

EXAMPLE

A diaphragm cell of the type disclosed in U.S. Pat. No. 2,447,547, issued to K. E. Stewart on Aug. 24, 1948, was modified to include the conducting means and anode attachment means described in FIG. 2.

A cell base having an overall dimension of 63 inches by 53¼ inches was constructed on a 1 inch steel plate as conducting layer 17 covered with a 0.010 inch thick sheet of fluorinated ethylene propylene polymer (FEP) as internal layer 16.

Before applying the FEP layer, holes for the anode post were drilled in the steel plate and copper bus bars were conductively fastened to the underside of the steel base. Two series of anode post holes were drilled. Each series was positioned in a straight line parallel to the center line and 14 inches from the center. The center line was perpendicular to the 63 inch side of the cell. Each series of holes contains 16 series of holes, the center of which are about 3 inches apart. The diameter of each hole was 1.125 inches.

Two copper conductor bars were welded to the underside of the steel base, one under each row of anode posts. The bars were 1 inch thick, 10 inches wide and, 54 inches long.

Holes were cut in the FEP sheet to match the holes drilled in the cell base. Using a template and a "cork-borer" cutting tool to make holes approximately 1.255 inches in diameter, sleeves of FEP tubing 1.25 inches inside diameter, 0.02 inches thick and 2 inches long were welded to the top side of the FEP sheet using a wooden "pegboard" template to support the sleeves as they were being welded.

Thirty-two anodes were employed, each anode being comprised of a mesh portion welded to the central anode post. The mesh portion of each anode was approximately 24½ inches in width, 1¼ inches in thickness and 18¼ inches high, being secured at the center to its width to the anode post having a diameter of 1.250 inches. Each post was constructed of a copper core approximately 1.17 inches in diameter clad with a 0.04 inch thick layer of titanium. The titanium and a slight amount of copper was machined off of the base end of each rod to leave a cylindrical copper base section ⅞ inches long by 1.115 inches in diameter.

Before assembly of the anodes through the base the upper portion of the base was cleaned with caustic and acid in preparation for soldering. Flux and solder wire (95 percent tin, 5 percent silver) were placed in each hole. The FEP sheet with welded sleeves was then put in place and the anodes were inserted one at a time through the respective sleeves through the holes in the cell base. Titanium hose clamps were installed around each sleeve as assembly progressed. Before melting the solder a jig was set over the anodes to hold them in proper alignment. The entire assembly was transferred to an oven maintained at 450° F. After 60 minutes the temperature of the assembly had reached the melting point of the solder (415° F.) and the assembly was removed from the oven to cool. The FEP sheet was slightly wrinkled from the heat. However, it was in tact and servicable. The titanium hose clamps were tightened. The anode assembly was placed on an insulated frame in operating position. The cathodes and cell can were then placed on the cell base. Suspended from the two sides of the cell can were 30 asbestos coated steel mesh cathodes alternately spaced between and parallel to the anodes.

The cell operated for extended periods with the minimum of maintenance and corrosion problems and with a high chlorine yield.

What is desired to be secured by Letters Patent is:

1. In an electrolytic cell comprised of a cell base having:

a. a non-metallic interior layer which provides an interior surface, b. a metal conducting layer which provides an exterior surface c. an interface between the bottom of said interior layer and the top of said conducting layer, d. a cell body secured to said cell base, 1. a plurality of diaphragm-coated cathodes secured to said cell body, e. a plurality of anodes, each anode comprising 1. a metallic conductive surface secured to, 2. an anode post, said anode post being secured to said cell base, 3. each metallic conductive surface being positioned adjacent to and parallel to at least one of said cathodes, f. and current conducting means secured to said exterior surface, characterized by the improvement which comprises in combination, g. soldered connections between each of said anode posts and said cell base in a separate opening for each of said anode posts, and h. liquid-tight sealing means between said interior layer and each of said anode posts.

2. The electrolytic cell of claim 1 wherein said liquid-tight sealing means is comprised of said interior layer said interior layer being elastic and having a. a plurality of openings to receive said anode posts, 1. each of said openings have a relaxed diameter smaller than the diameter of each of said anode posts.

2. the distance between the center of any two adjacent openings in said interior layer being greater than the distance between the centers of the anode posts positioned in said adjacent openings, 3. said openings being raised from said interface between said interior layer and said conducting layer, whereby a liquid-tight sealing means is secured between the wall of each of said openings and the corresponding anode post.

3. The electrolytic cell of claim 1 wherein said sealing means is comprised of a. holes in said interior layer having a diameter at least as large as the outside diameter of each of the corresponding anode posts, b. sleeves positioned above each of said holes, 1. the diameter of each sleeve corresponding to the outside diameter of said anode posts, 2. the lower end of said sleeves being secured to said interior layer, c. the upper end of said sleeves being secured by adjustable clamp means to said anode posts, whereby a liquid-tight sealing means is obtained between said anode, said interior layer and said anode posts.

4. The electrolytic cell of claim 3 wherein the diameter of said holes is the same as the diameter of said anode posts.

5. The electrolytic cell of claim 3 wherein the diameter of said holes is larger than the outside diameter of said anode posts.

6. The electrolytic cell of claim 1 wherein said opening in said cell base extends completely through said cell base.

7. The electrolytic cell of claim 1 wherein said openings in said cell base extend partially through said cell base.

8. The electrolytic cell of claim 3 wherein the composition of said solder is comprised of about 95 percent by weight of tin and about 5 percent by weight of silver.

* * * * *